US012642403B2

(12) United States Patent
Hill

(10) Patent No.: US 12,642,403 B2
(45) Date of Patent: Jun. 2, 2026

(54) ROBOTIC CLEANER

(71) Applicant: SHARKNINJA OPERATING LLC, Needham, MA (US)

(72) Inventor: Alexander S. Hill, Surrey (GB)

(73) Assignee: SharkNinja Operating LLC, Needham, MA (US)

( * ) Notice: Subject to any disclaimer, the term of this patent is extended or adjusted under 35 U.S.C. 154(b) by 0 days.

(21) Appl. No.: 17/852,810

(22) Filed: Jun. 29, 2022

(65) Prior Publication Data

US 2022/0408994 A1 Dec. 29, 2022

Related U.S. Application Data

(60) Provisional application No. 63/216,157, filed on Jun. 29, 2021.

(51) Int. Cl.
*A47L 9/10* (2006.01)

(52) U.S. Cl.
CPC ..... *A47L 9/104* (2013.01); *A47L 2201/04* (2013.01)

(58) Field of Classification Search
CPC ..... A47L 9/1658; A47L 9/1666; A47L 9/104; A47L 9/1683; A47L 9/122; A47L 9/1409; A47L 9/1691; A47L 9/22; A47L 9/1436; A47L 9/1489
USPC ..... 15/422
See application file for complete search history.

(56) References Cited

U.S. PATENT DOCUMENTS 6,442,791 B1 * 9/2002 McRae Thomson ..... A47L 5/28 15/352
8,505,158 B2 8/2013 Han et al.
8,741,013 B2 6/2014 Swett et al.
2005/0229777 A1 * 10/2005 Brown ..... B01D 46/44 96/417
2008/0010958 A1 * 1/2008 Fester ..... B01D 46/521 55/482
2008/0168616 A1 7/2008 Tanaka et al.
2010/0212106 A1 * 8/2010 Sepke ..... A47L 9/1683 15/347
2011/0214567 A1 * 9/2011 McClearen ..... A47L 9/00 15/327.2
2013/0058635 A1 3/2013 Vrdoljak
2013/0152337 A1 6/2013 Thorne
2013/0232718 A1 * 9/2013 Baek ..... A47L 9/1427 15/319

(Continued)

FOREIGN PATENT DOCUMENTS

CN 110192812 A * 9/2019 ..... A47L 11/24
CN 209611018 U * 11/2019

(Continued)

OTHER PUBLICATIONS

Translation of CN-211324793-U (Year: 2020).*

(Continued)

*Primary Examiner* — David S Posigian
*Assistant Examiner* — Steven Huang
(74) *Attorney, Agent, or Firm* — Secant IP PLLC

(57) ABSTRACT

A robotic cleaner may include a suction motor, a dust cup, and a suction motor air duct fluidly coupled to the suction motor and the dust cup. The suction motor air duct may include a debris barrier having a restricting region and a guard region.

13 Claims, 10 Drawing Sheets

(56) References Cited

U.S. PATENT DOCUMENTS

2013/0305483 A1* 11/2013 Dyson ..... A47L 9/122 15/353
2014/0150201 A1 6/2014 Mcgee et al.
2015/0013102 A1 1/2015 Bilger
2015/0040340 A1 2/2015 Bilger et al.
2015/0135474 A1 5/2015 Gidwell
2015/0297054 A1 10/2015 Weeks et al.
2015/0351596 A1 12/2015 Thorne et al.
2016/0128530 A1 5/2016 Thorne et al.
2016/0174793 A1 6/2016 Burke et al.
2016/0220080 A1 8/2016 Thorne
2016/0220081 A1 8/2016 Xu et al.
2016/0220082 A1 8/2016 Thorne et al.
2016/0324388 A1 11/2016 Vrdoljak et al.
2016/0374533 A1 12/2016 Innes et al.
2017/0042319 A1 2/2017 Conrad et al.
2017/0112343 A1 4/2017 Innes et al.
2017/0127896 A1 5/2017 Carter et al.
2017/0144810 A1 5/2017 Birdsell
2017/0215667 A1 8/2017 Thorne et al.
2017/0347848 A1 12/2017 Carter et al.
2018/0035854 A1 2/2018 Thorne
2018/0064301 A1 3/2018 Cottrell et al.
2018/0068815 A1 3/2018 Cottrell
2018/0070785 A1 3/2018 Udy et al.
2018/0255991 A1 9/2018 Der Marderosian et al.
2018/0296046 A1 10/2018 Thorne et al.
2018/0306432 A1 10/2018 Ognjen et al.
2018/0325252 A1 11/2018 Hopke et al.
2018/0338654 A1 11/2018 Kelsey
2018/0338656 A1 11/2018 Carter et al.
2019/0038098 A1 2/2019 Thorne et al.
2019/0059668 A1 2/2019 Thorne et al.
2019/0069740 A1 3/2019 Thorne et al.
2019/0069744 A1 3/2019 Liggett et al.
2019/0090701 A1 3/2019 Tonderys et al.
2019/0090705 A1 3/2019 Thorne et al.
2019/0142233 A1 5/2019 Swett et al.
2019/0191947 A1 6/2019 Freese et al.
2019/0193120 A1 6/2019 Brown et al.
2019/0246853 A1 8/2019 Sardar et al.
2019/0274500 A1 9/2019 Thorne et al.
2019/0274501 A1 9/2019 Antonisami et al.
2019/0302793 A1 10/2019 Leech et al.
2019/0320865 A1 10/2019 Brown et al.
2019/0320866 A1 10/2019 Thorne et al.
2019/0335968 A1 11/2019 Harting et al.
2019/0343349 A1 11/2019 Clare et al.
2019/0357740 A1 11/2019 Thorne et al.
2020/0000298 A1 1/2020 Brown et al.
2020/0000301 A1 1/2020 Morin et al.
2020/0022543 A1 1/2020 Gill et al.
2020/0022544 A1 1/2020 Gill et al.
2020/0022553 A1 1/2020 Gill et al.
2020/0037833 A1 2/2020 Niedzwecki et al.
2020/0037843 A1 2/2020 Fiebig et al.
2020/0046184 A1 2/2020 Freese et al.
2020/0077855 A1 3/2020 Brown et al.
2020/0085267 A1 3/2020 Thorne et al.
2020/0085269 A1 3/2020 Thorne
2020/0121144 A1 4/2020 Gacin et al.
2020/0121148 A1 4/2020 Hoffman et al.
2020/0138260 A1 5/2020 Sutter et al.
2020/0166949 A1 5/2020 Leech et al.
2020/0170470 A1 6/2020 Liggett et al.
2020/0201348 A1 6/2020 Leech et al.
2020/0205631 A1 7/2020 Brown et al.
2020/0205634 A1 7/2020 Sutter et al.
2020/0237171 A1 7/2020 Xu et al.
2020/0288929 A1 9/2020 Brunner
2020/0288930 A1 9/2020 Wells
2020/0297172 A1 9/2020 Tonderys et al.
2020/0301430 A1 9/2020 Irkliy et al.
2020/0315418 A1 10/2020 Howard et al.
2020/0345196 A1 11/2020 Innes et al.
2020/0367711 A1 11/2020 Thorne et al.
2020/0371526 A1 11/2020 Kamada
2020/0383547 A1 12/2020 Sutter et al.
2021/0007569 A1 1/2021 Howard et al.
2021/0022574 A1 1/2021 Harting
2021/0030227 A1 2/2021 Mathieu et al.
2021/0038032 A1 2/2021 Brown
2021/0059495 A1* 3/2021 Gill ..... A47L 11/4027
2021/0085144 A1 3/2021 Woodrow et al.
2021/0169289 A1 6/2021 Thorne et al.
2021/0175772 A1 6/2021 Aini
2021/0177223 A1 6/2021 Der Marderosian et al.
2021/0186282 A1 6/2021 Mathieu et al.
2021/0204684 A1 7/2021 Heman-Ackah et al.
2021/0254615 A1 8/2021 Burbank
2021/0307581 A1 10/2021 Thorne et al.
2021/0315428 A1 10/2021 Udy et al.
2021/0386261 A1 12/2021 Woodrow et al.
2021/0386262 A1 12/2021 Uchendu et al.
2022/0031131 A1 2/2022 McClay et al.
2022/0031133 A1 2/2022 Der Marderosian et al.
2022/0031134 A1 2/2022 Yang et al.
2022/0061614 A1 3/2022 Yu et al.
2022/0071459 A1 3/2022 Gacin et al.
2022/0095864 A1 3/2022 Der Marderosian et al.
2022/0125256 A1 4/2022 Lessard et al.
2022/0287521 A1 9/2022 Cottrell et al.
2022/0322903 A1 10/2022 Lessard
2022/0400922 A1 12/2022 McClay et al.
2022/0408994 A1 12/2022 Hill
2023/0043567 A1 2/2023 Copeland et al.
2023/0070147 A1 3/2023 Harting et al.
2023/0157495 A1 5/2023 Copeland et al.
2023/0248192 A1 8/2023 Brown et al.
2023/0320550 A1 10/2023 Teuscher et al.
2023/0329502 A1 10/2023 Chirikjian
2023/0355065 A1 11/2023 Finnegan
2023/0414052 A1 12/2023 McClay et al.
2024/0008699 A1 1/2024 Innes et al.
2024/0415352 A1 12/2024 Mcclay et al.

FOREIGN PATENT DOCUMENTS

CN 211324793 U * 8/2020
CN 112576531 A * 3/2021
CN 112746980 A * 5/2021 ..... F04D 25/08
CN 214231212 U * 9/2021
DE 202009017629 U1 * 6/2011 ..... A47L 5/22
GB 717578 A * 10/1954
WO WO-2021145526 A1 * 7/2021 ..... A47L 9/009

OTHER PUBLICATIONS

Translation of CN-112746980-A (Year: 2021).*
Translation of CN-112576531-A (Year: 2021).*
Translation of CN-209611018-U (Year: 2019).*
Translation of CN-110192812-A (Year: 2019).*
Translation of DE 202009017629 U1 (Year: 2011).*
Translation of CN 214231212 U (Year: 2021).*
PCT Search Report and Written Opinion, mailed Oct. 5, 2022, received in corresponding PCT Application No. PCT/US22/35474, 10 pages.

* cited by examiner

| | GRID 1400; BASELINE CUP | GRID 1400; CUP 304 | CFM DUCT 300 ALONE; CUP 304 | BARRIER 415; CUP 304 | TILTED MOTOR | TILTED MOTOR DUCT 300 ALONE |
|---|---|---|---|---|---|---|
| CFM | 15 | 14.3 | 15.2 | 14.8 | 14.2 | 14.95 |

ROBOTIC CLEANER

CROSS-REFERENCE TO RELATED APPLICATIONS

The present application claims the benefit of U.S. Provisional Application Ser. No. 63/216,157 filed on Jun. 29, 2021, entitled Robotic Cleaner, which is fully incorporated herein by reference.

TECHNICAL FIELD

The present disclosure is generally directed to automated cleaning apparatuses and more specifically to robotic cleaners having at least one dust cup.

BACKGROUND INFORMATION

Autonomous cleaning devices are configured to autonomously navigate a surface while at least partially cleaning the surface. One example of an autonomous cleaning device is a robotic vacuum cleaner. A robotic vacuum cleaner may include a controller, a plurality of driven wheels, a suction motor, a brush roll, and a dust cup. A suction motor air duct fluidly couples the suction motor to the dust cup. In operation, the suction motor is configured to generate a suction force at a dirty air inlet to the dust cup, causing air to flow into the dust cup through the suction motor air duct and into the suction motor. As such, while traversing the surface to be cleaned, debris is urged into the dust cup as a result of the suction generated by the suction motor. Debris collected within the dust cup may be emptied by removing the dust cup from the robotic vacuum cleaner, exposing a duct inlet of the suction motor duct. An exposed duct inlet may allow debris to inadvertently enter the suction motor air duct. Large debris that enters the suction motor air duct may become lodged in the suction motor, which may damage the suction motor (e.g., by impeding the rotation of an impeller of the suction motor).

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a robotic cleaner. The robotic cleaner may include a body, a dust cup removably coupled to the body and having a dirty air inlet and a clean air outlet, a suction motor configured to generate a suction force at the dirty air inlet of the dust cup, and a suction motor air duct fluidly coupling the dust cup to the suction motor. The suction motor air duct includes a duct inlet proximate to the clean air outlet of the dust cup. When the dust cup is removed from the body of the robotic cleaner, the duct inlet is exposed. The suction motor air duct includes a debris barrier assembly (e.g., proximate to the duct inlet) configured to prevent large debris (e.g., debris having a maximum dimension of at least 2.5 millimeters, at least 3 millimeters, at least 3.5 millimeters, or at least 4 millimeters) from inadvertently entering the suction motor air duct via the duct inlet when the dust cup is removed from the body of the robotic cleaner. The debris barrier assembly includes a guard region and a restricting region. The guard region is configured to allow air to pass therethrough and the restricting region is configured to restrict (e.g., prevent or reduce) air passing therethrough.

In some instances, the dust cup may include one or more filter mediums disposed within the airflow path between the dirty air inlet and the clean air outlet. For example, the dust cup may be configured to receive a filter medium and a plenum may extend over the filter medium. The filter medium may be coupled to a filter frame, the filter frame may be configured to removably couple to the dust cup. The filter frame may be configured to improve airflow within the plenum.

Figure 1:
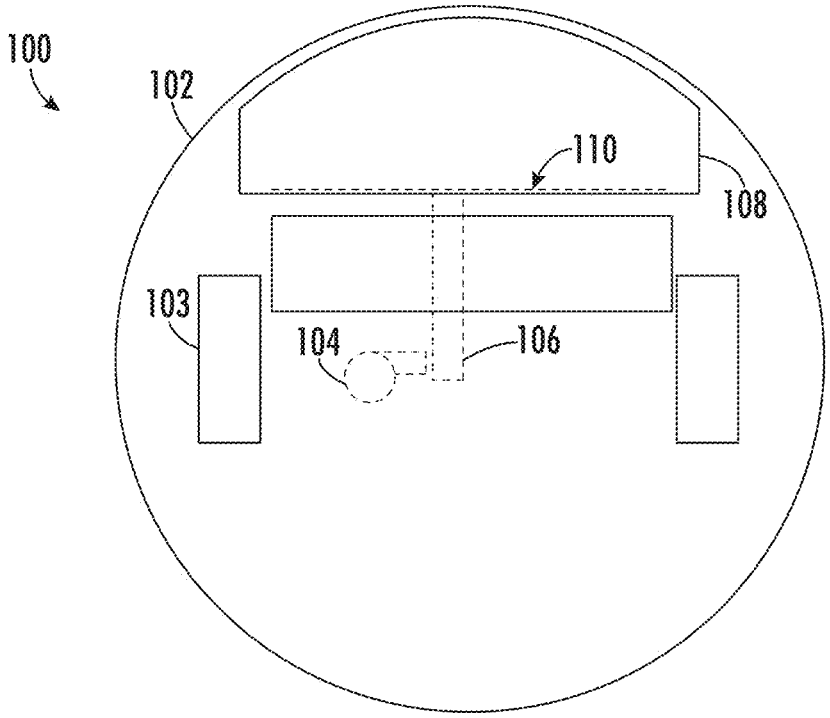
FIG. 1 is a schematic bottom view of an example of a robotic cleaner, consistent with embodiments of the present disclosure.

FIG. 1 shows a schematic example of a robotic cleaner 100. As shown, the robotic cleaner 100 includes a body 102, one or more driven wheels 103 configured to urge the body 102 across a surface to be cleaned (e.g., a floor), a suction motor 104 (shown in hidden lines), a suction motor air duct 106 (shown in hidden lines), and a dust cup 108 removably coupled to the body 102. The suction motor air duct 106 fluidly couples (e.g., directly fluidly couples) the suction motor 104 to the dust cup 108.

In operation, the suction motor 104 is configured to cause air to flow into a dirty air inlet 110 (generally shown with a hidden line) of the dust cup 108. The air flowing into the dirty air inlet 110 may have debris entrained therein. At least a portion of the entrained debris may be deposited in the dust cup 108. The dust cup 108 can be removed from the body 102 of the robotic cleaner 100 to empty debris collected within the dust cup 108.

Figure 2:
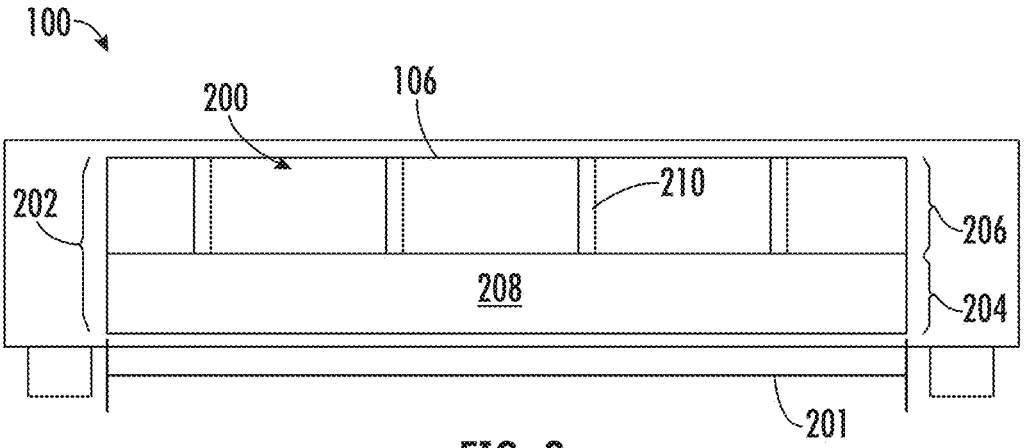
FIG. 2 is a schematic end view of the robotic cleaner of FIG. 1, consistent with embodiments of the present disclosure.

FIG. 2 shows an end view of the robotic cleaner 100 of FIG. 1 having the dust cup 108 removed therefrom (e.g., for emptying of debris). As shown, when the dust cup 108 is removed, a duct inlet 200 is exposed. To prevent large debris from entering the suction motor air duct 106 and becoming lodged within the suction motor 104, the suction motor air duct 106 may include a debris barrier 202. The debris barrier 202 may include a restricting region 204 and a guard region 206. The restricting region 204 and/or guard region 206 may extend across an entire inlet width 201 of the duct inlet 200.

The restricting region 204 may include one or more plates 208 (e.g., a plurality of spaced apart plates 208) that are substantially impermeable to air. When the restricting region 204 includes a plurality of spaced apart plates 208, a combined surface area of a dust cup facing surface of the plates 208 may be greater than the combined area of the regions separating the plates 208. The restricting region 204 can be configured to augment the airflow passing through the suction motor air duct 106. For example, the plate 208 can be shaped to encourage a smooth transition of air flowing into the suction motor air duct 106. As shown, the guard region 206 includes a plurality of spaced apart protrusions 210, wherein air is configured to flow between the protrusions 210. A combined surface area of a dust cup facing surface of the protrusions 210 may be less than a combined area of the regions separating the protrusions 210.

In some instances, at least a portion of the debris barrier 202 may be integrally formed from and/or coupled to the suction motor air duct 106. For example, the protrusions 210 may be integrally formed from the suction motor air duct 106 and/or the plate 208 may be integrally formed from the suction motor air duct 106. By way of further example, the protrusions 210 may be coupled to (e.g., using one or more adhesives, one or more mechanical fasteners, and/or any other form of coupling) the suction motor air duct 106 and/or the plate 208 may be coupled to the suction motor air duct 106. Use of couplings to couple at least a portion of the debris barrier 202 to the suction motor air duct 106 may have an adverse impact on air flow compared to when the debris barrier 202 is integrally formed from the suction motor air duct 106.

Figure 3:
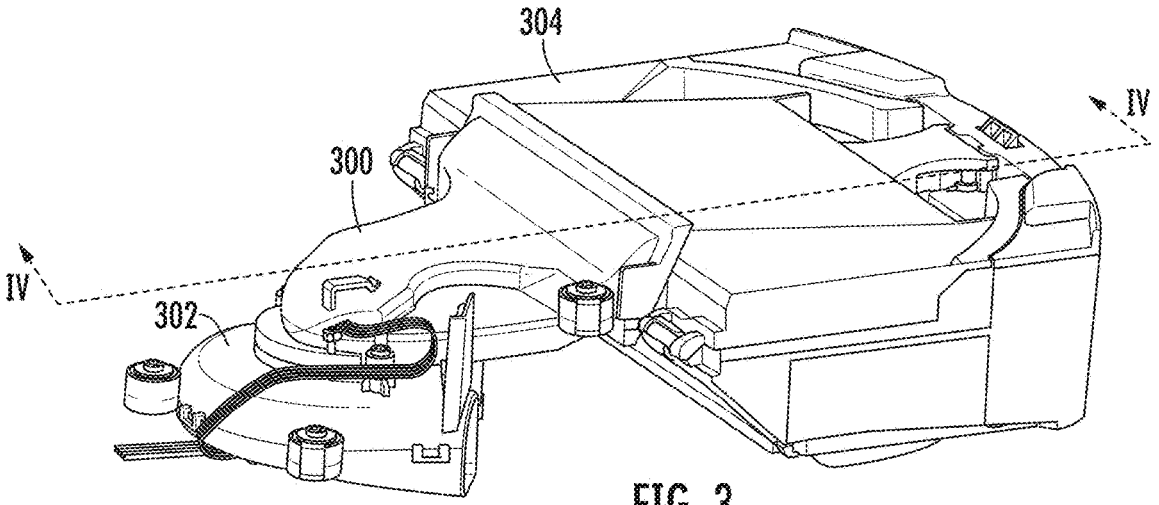
FIG. 3 is a perspective view of a suction motor, suction motor air duct, and dust cup removed from a robotic cleaner, consistent with embodiments of the present disclosure.

FIG. 3 shows a perspective view of an example of a suction motor air duct 300 (which may be an example of the suction motor air duct 106) fluidly coupled to a suction motor 302 (which may be an example of the suction motor 104) and a dust cup 304 (which may be an example of the dust cup 108). The suction motor 302 is configured to draw air into the dust cup 304 and the through the suction motor air duct 300.

Figure 4:
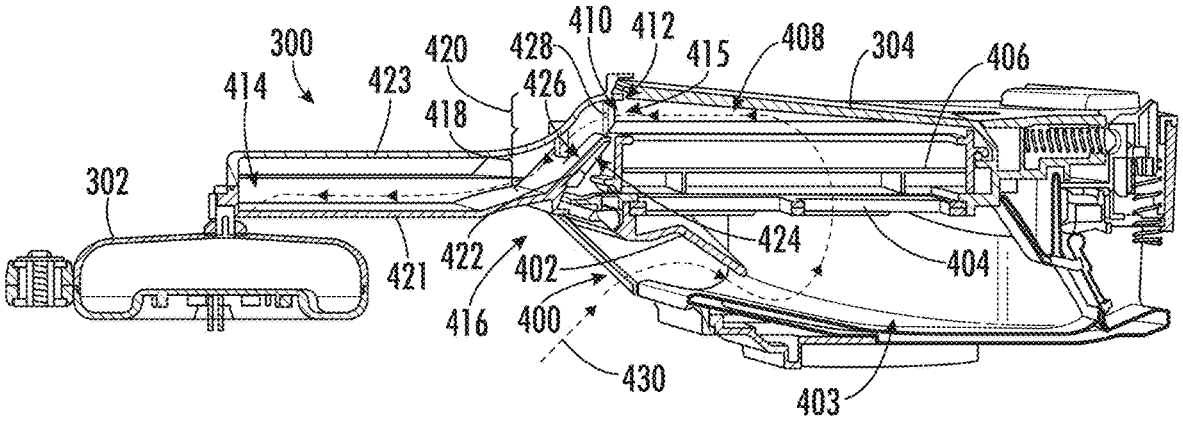
FIG. 4 is a cross-sectional view taken along the line IV-IV of FIG. 3, consistent with embodiments of the present disclosure.

FIG. 4 shows a cross-sectional view of the suction motor air duct 300, the suction motor 302, and the dust cup 304 taken along the line IV-IV of FIG. 3. As shown, the dust cup 304 includes a dirty air inlet 400, a debris fin 402 extending into a debris cavity 403 of the dust cup 304, a first filter medium 404, a second filter medium 406, a plenum 408, and a clean air outlet 410.

The suction motor air duct 300 includes a duct inlet 412, a duct outlet 414, and a debris barrier 416. As shown, the suction motor air duct 300 may be made of two or more separate parts (e.g., a duct bottom portion 421 and a duct top portion 423) that are coupled together. The duct inlet 412 is fluidly coupled to the clean air outlet 410 of the dust cup 304 and the duct outlet 414 is fluidly coupled to the suction motor 302. The debris barrier 416 is positioned within the suction motor air duct 300 at location between the duct inlet 412 and the duct outlet 414. For example, the debris barrier 416 may be positioned proximate to the duct inlet 412 (e.g., at distance from the duct inlet 412 measuring less than 35%, 30%, 25%, 20%, 10%, 5%, or 1% of the largest dimension of the suction motor air duct 300).

The debris barrier 415 includes a restricting region 418 and a guard region 420. As shown, the restricting region 418 includes one or more blocking plates 422 having a blocking side 424 and an airflow side 426, wherein the airflow side 426 defines at least a portion of an inner surface of the suction motor air duct 300 and the blocking side 424 faces the dust cup 304. The blocking plate 422 may be coupled to or integrally formed from the suction motor air duct 300 (e.g., the duct bottom portion 421).

As also shown, the guard region 420 includes a plurality of spaced apart protrusions 428 between which air flows. The plurality of spaced apart protrusions 428 extend from the duct top portion 423 in a direction of the blocking plate 422. The plurality of spaced apart protrusions 428 may be coupled to or integrally formed from the suction motor air duct 300 (e.g., the duct top portion 423). Integrally forming the protrusions 428 and/or the blocking plate 422 with the duct top portion 423 and/or the duct bottom portion 421 may simplify the assembly process, reduce the number of fasteners, and/or increase the area available for airflow.

In operation, the suction motor 302 is configured to cause air to flow along a flow path 430. As shown, the flow path 430 extends from the dirty air inlet 400 along a surface of the debris fin 402 and into the debris cavity 403. From the debris cavity 403, the flow path 430 extends through the first filter medium 404 and the second filter medium 406 and into the plenum 408. The first filter medium 404 may be configured to collect larger debris than the second filter medium 406. For example, the first filter medium 404 may be a mesh screen and the second filter medium 406 may be a pleated filter. In some instances, the second filter medium 406 may be a high efficiency particulate air (HEPA) filter.

Within the plenum 408, the flow path 430 is caused to change direction (e.g., the flow path 430 may have an at least 80° change in direction, an at least 85° change in direction, or an at least 90° change in direction). The distance over which the change in direction occurs may have an impact on performance.

Figure 12:
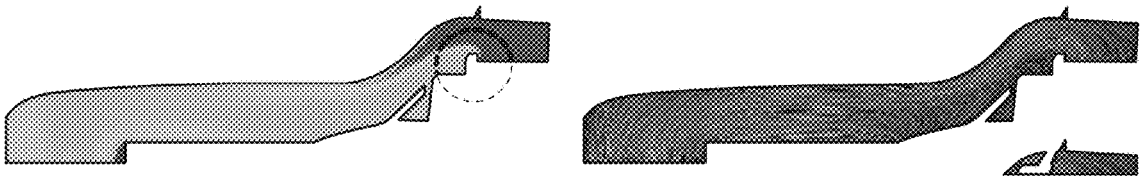
FIG. 12 is a CFD analysis of the suction motor air duct of FIG. 3 having the debris barrier of FIG. 4, consistent with embodiments of the present disclosure.
Figure 13:
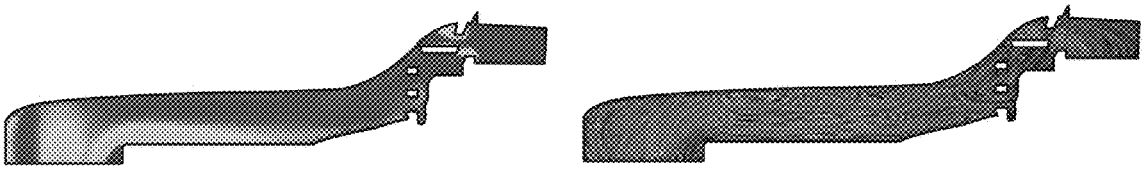
FIG. 13 is a CFD analysis of the suction motor air duct of FIG. 3 having a grid structure, consistent with embodiments of the present disclosure.
Figure 14:
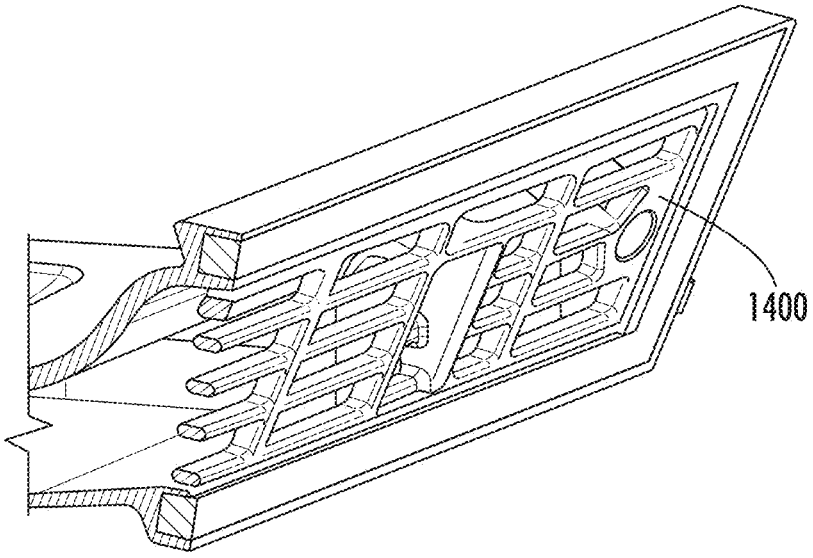
FIG. 14 is a cross-sectional view of a grid structure, consistent with embodiments of the present disclosure.
Figure 15:
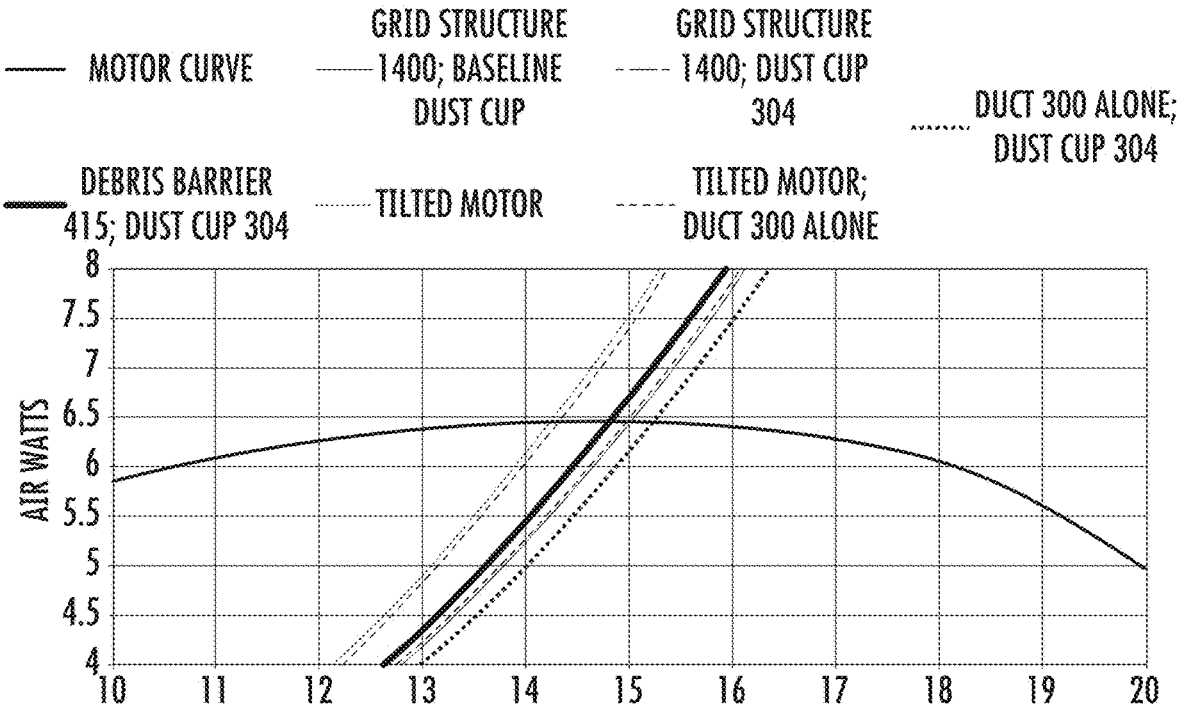
FIG. 15 is a performance plot of various configurations of the suction motor air duct and robotic cleaner, consistent with embodiments of the present disclosure.

From the plenum 408 the flow path 430 extends through the clean air outlet 410 and duct inlet 412 and into the suction motor air duct 300. When passing through the suction motor air duct 300, the flow path 430 extends between the spaced apart protrusions 428 of the debris barrier 415 and along the airflow side 426 of the blocking plate 422 of the debris barrier 415. The airflow side 426 of the blocking plate 422 can be configured to encourage a smooth airflow transition of air passing into the suction motor air duct 300. For example, the airflow side 426 of the blocking plate 422 and the suction motor air duct 300 may include one or more planar surfaces (e.g., angled planar surfaces) and/or arcuate surfaces to encourage smooth airflow. From the suction motor air duct 300, the flow path 430 extends through the duct outlet 414 and into the suction motor 302. FIG. 12 shows a computational fluid dynamics (CFD) analysis corresponding to a suction motor air duct 300 having the debris barrier 415 and FIG. 13 shows a CFD analysis corresponding to the suction motor air duct 300 having a grid structure 1400 to block debris (see, FIG. 14) coupled thereto. As shown, the debris barrier 415 provides improved performance relative to the grid structure 1400 (e.g., the debris barrier 415 may provide a performance increase of approximately 2.8 air watts). FIG. 15 shows a performance plot comparing the suction motor air duct 300 having the debris barrier 415, the suction motor air duct 300 having the grid structure 1400, the suction motor air duct 300 alone (e.g., without the debris barrier 415 or grid structure 1400), and the impact of an orientation of the suction motor 302 (e.g., vertical impeller rotation axis and tilted/non-vertical impeller rotation axis).

Figure 5:
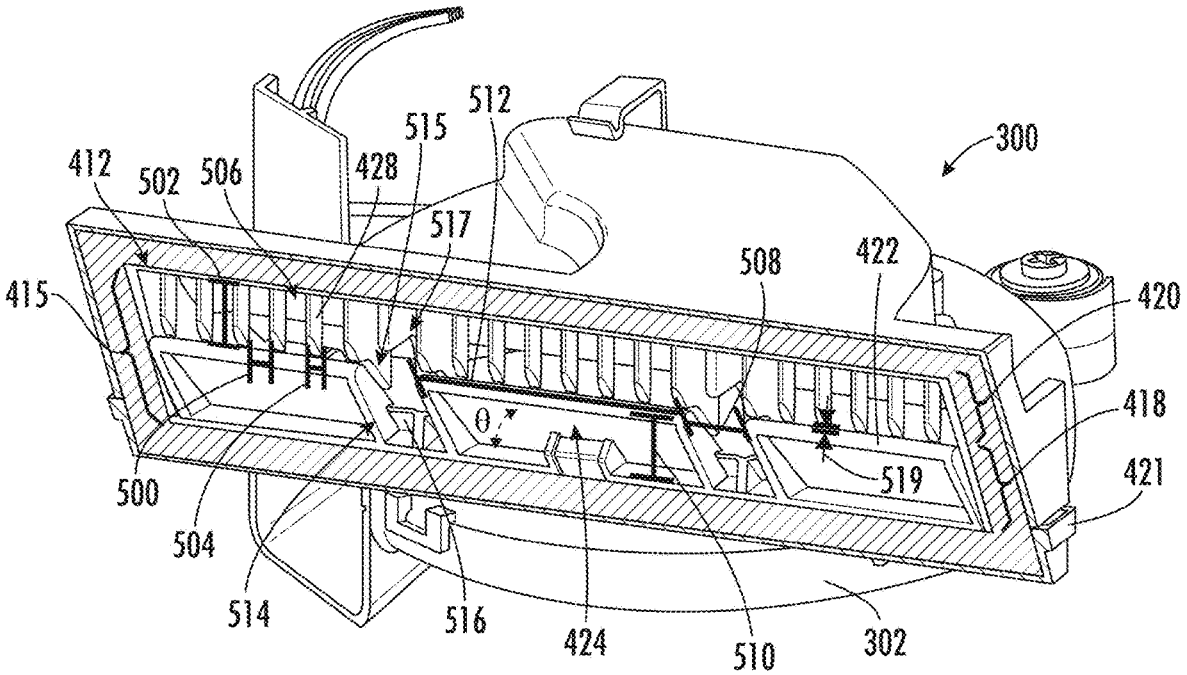
FIG. 5 is a perspective view of the suction motor and suction motor air duct of FIG. 3, consistent with embodiments of the present disclosure.

FIG. 5 shows a perspective view of the suction motor air duct 300 and the suction motor 302, wherein the dust cup 304 has been removed therefrom (e.g., for emptying debris accumulated within the dust cup 304). As shown, when the dust cup 304 is removed, the duct inlet 412 is exposed to the surrounding environment. The debris barrier 415 prevents large debris (e.g., debris capable of causing damage to the suction motor 302 if it becomes lodged therein) from entering the suction motor air duct 300 when the dust cup 304 is removed.

As shown, the plurality of protrusions 428 are spaced apart by a protrusion separation distance 500 and have a protrusion length 502 and a protrusion width 504. As shown, the protrusion separation distance 500 extends between immediately adjacent protrusions 428. A protrusion passthrough region 506 is defined between immediately adjacent protrusions 428. In other words, immediately adjacent protrusions 428 may be separated by a respective protrusion passthrough region 506. Each protrusion passthrough region 506 defines an open area. The open area defined by a respective protrusion passthrough region 506 may be greater than the combined leading surface area of the protrusions 428 (e.g., the leading surface of the protrusion 428 being the surface facing the airflow) defining the protrusion passthrough region 506. The leading surface area for a respective protrusion 428 may be the protrusion length 502 multiplied by the protrusion width 504. In some instances, a combined open area (i.e., the summation of each open area within the guard region 420) may be, for example, in a range of 500 square millimeters ($mm^2$) to 700 $mm^2$. By way of further example, the combined open area may be in a range of 550 $mm^2$ to 600 $mm^2$. By way of still further example, the combined open area may be in a range of 650 $mm^2$ to 700 $mm^2$. In some instances (see, e.g., the discussion accompanying FIGS. 6-10), the size and/or shape of the plenum 408 may be optimized to, for example, maximize the combined open area (e.g., without increasing a size of the dust cup 304). Increasing the open area may improve performance (e.g., by increasing the air watts of the system).

The protrusion separation distance 500 may be, for example, in a range of 2 millimeters (mm) to 4 mm. By way of further example, the protrusion separation distance 500 may be 3 mm. By way of still further example, the protrusion separation distance 500 may be 3.5 mm. The protrusion separation distance 500 may be constant within the guard region 420. Alternatively, the protrusion separation distance 500 may not be constant within the guard region 420. For example, the protrusion separation distance 500 may increase with increasing distance from a center of the duct inlet 412. In this example, the open area defined by the protrusion passthrough regions 506 may increase with increasing distance from the center of the duct inlet 412.

The protrusion length 502 may be, for example, in a range of 2 mm to 4 mm. By way of further example, the protrusion length 502 may be 3 mm. By way of still further example, protrusion length 502 may be 3.5 mm. The protrusion length 502 may not be constant within the guard region 420. For example, the protrusion length 502 for one or more of the protrusions 428 may be less than the protrusion length 502 for at least one other protrusion 428 (e.g., to facilitate the fluid coupling of the dust cup 304 to the suction motor air duct 300). Alternatively, the protrusion length 502 may be the same for each protrusion.

The protrusion width 504 may be the same for each protrusion 428. Alternatively, the protrusion width 504 for one or more protrusions 428 may be less than the protrusion width 504 of at least one other protrusion 428. For example, the protrusion width 504, for each protrusion 428, may increase with increasing distance from a center of the duct inlet 412.

As shown, the restricting region 418 includes a plurality of the blocking plates 422 spaced apart by a plate separation distance 508 and having a plate length 510 and a plate width 512. A plate passthrough region 514 is defined between immediately adjacent blocking plates 422. In other words, immediately adjacent blocking plates 422 are separated by a respective plate passthrough region 514. Each plate passthrough region 514 defines an open area. The open area defined by a respective plate passthrough region 514 may be less than the surface area of the blocking sides 424 (e.g., the surface area defined by the plate length 510 and the plate width 512) of the blocking plates 422 that define the respective plate passthrough region 514. As shown, in some instances, the protrusions 428 immediately adjacent to opposing sides of the plate passthrough region 514 have an end profile 515 that generally corresponds to a shape of the corresponding blocking plate 422 such that at least a portion of the protrusion 428 extends along the airflow side 426 of the blocking plate 422. As also shown, in some instances, the protrusion 428 extending from a location that is between immediately adjacent plates 422 may have an end profile 517, wherein the protrusion length 502 changes from a first protrusion length to a second, greater, protrusion length. In some instances, the plate passthrough region 514 may include an obstruction plate 516 that reduces the open area of the plate passthrough region 514. For example, the obstruction plate 516 may be configured to reduce the open area of the plate pass through region 514 by 5% to 50%. As also shown, protrusions 428 extending over a respective blocking plate 422 may be spaced a part from the blocking plate 422 by a plate-protrusion separation distance 519. The plate-protrusion separation distance 519 may be less than, or equal to, the protrusion separation distance 500. The plate-protrusion separation distance 519 may be the same or different for each protrusion 428.

The plate separation distance 508 may be the same within the restricting region 418. Alternatively, the plate separation distance 508 may be different within the restricting region 418. The plate length 510 may be the same for each blocking plate 422 within the restricting region 418. Alternatively, the plate length 510 for at least one blocking plate 422 may be different from the plate length 510 of at least one other blocking plate 422. For example, the plate length 510, for each blocking plate 422, may decrease with increasing distance from a center of the suction motor air duct 300. The plate width 512 may be the same for each blocking plate 422 within the restricting region 418. Alternatively, the plate width 512 for at least one blocking plate 422 may be different from the plate width 512 for at least one other blocking plate 422. For example, the plate width 512, for each blocking plate 422, may decrease with increasing distance from a center of the suction motor air duct 300.

As shown, each blocking plate 422 extends from the duct bottom portion 421 of the suction motor air duct 300 at a plate angle θ. The plate angle θ extends between the blocking side 424 of a respective blocking plate 422 and the duct bottom portion 421. The plate angle θ may be a non-perpendicular angle (e.g., an acute angle). For example, the plate angle θ may be at least 45°. By way of further example, the plate angle θ may be between 45° and 90°.

The plate angle θ may be the same for each blocking plate 422 within the restricting region 418. Alternatively, the plate angle θ for at least one blocking plate 422 may be different from the plate angle θ of at least one other blocking plate 422. For example, the plate angle θ corresponding to each blocking plate 422 may increase with increasing distance from a center of the suction motor air duct 300. In some instances, the obstruction plate 516 may extend from the duct bottom portion 421 at the plate angle θ.

Figure 6:
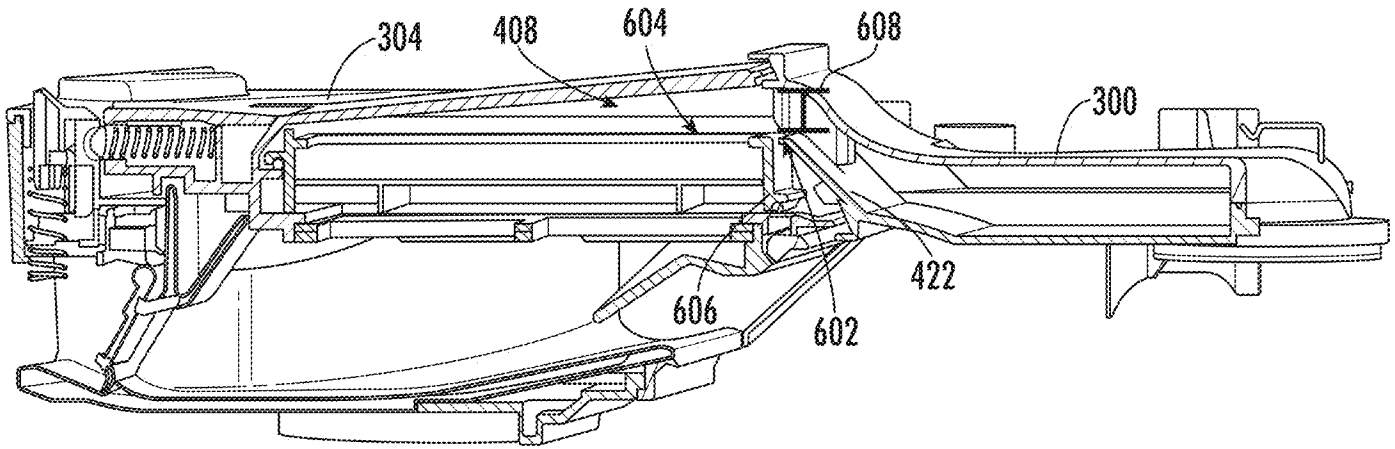
FIG. 6 is a cross-sectional view of the suction motor air duct and the dust cup of FIG. 3, consistent with embodiments of the present disclosure.

FIG. 6 shows a cross-sectional view of the suction motor air duct 300 and dust cup 304 with the suction motor 302 removed therefrom for clarity of illustration. As shown, each blocking plate 422 extends such that a top surface 602 of each blocking plate 422 is proximate to the plenum 408. For example, the top surface 602 may be substantially co-planar with at least one surface forming a bottom portion 604 of the plenum 408. When the top surface 602 is arcuate, the top surface 602 of the blocking plate 422 may be considered to be co-planar with at least a portion of the bottom portion 604 when the upper most portion of the blocking plate 422 is substantially tangent with at least one surface forming the bottom portion 604 of the plenum 408.

The bottom portion 604 of the plenum 408 may be defined, at least in part, by one or more of the second filter medium 406 and/or a filter frame 606 within which the second filter medium 406 is disposed. In this instance, the top surface 602 of each blocking plate 422 may be substantially coplanar with a plane defined by the second filter medium 406 and/or the filter frame 606.

In some instances, the size and/or shape of the plenum 408 may be optimized to improve airflow. For example, optimizing the size and/or shape of the plenum 408 may include increasing a plenum height 608 without increasing a size of the dust cup 304. Adjusting a sizing and/or shape of the plenum 408 may include adjusting the filter frame 606 of the second filter medium 406.

Figure 7:
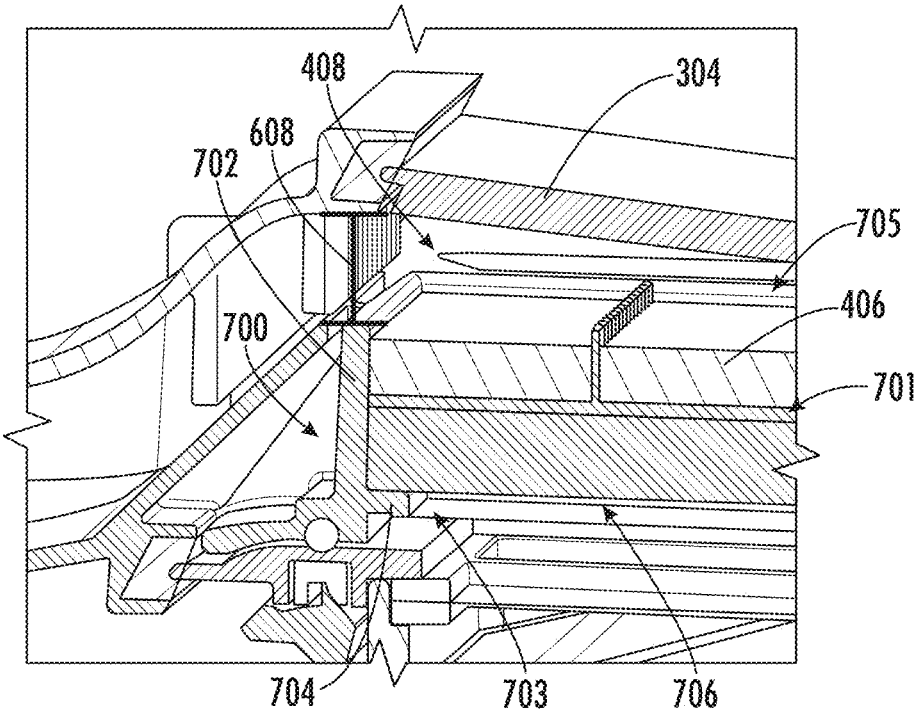
FIG. 7 is a cross-sectional view of a portion of a suction motor air duct, a dust cup, and a filter frame, consistent with embodiments of the present disclosure.
Figure 8:
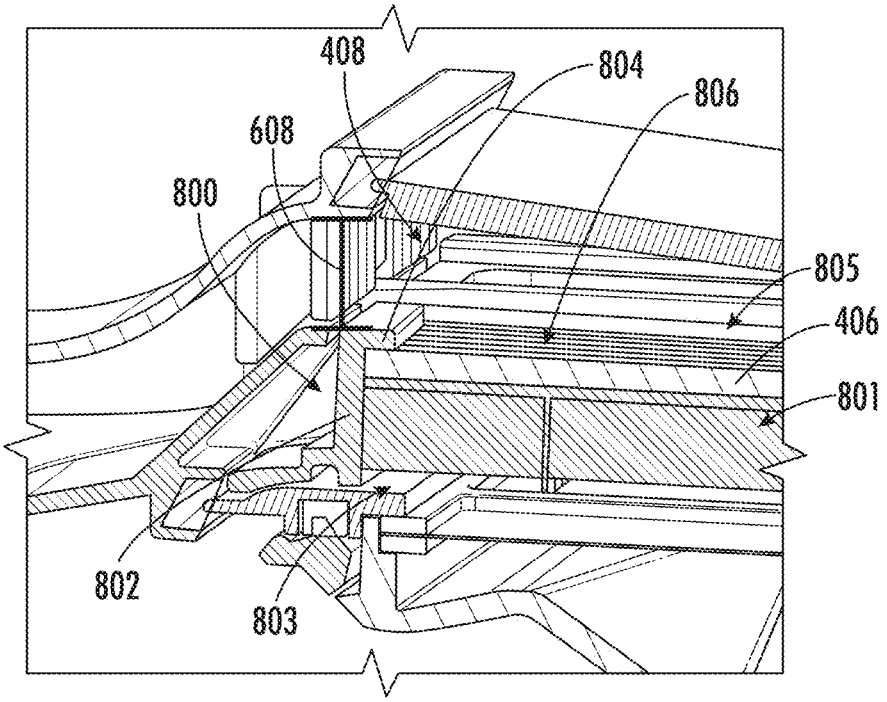
FIG. 8 is a cross-sectional view of a portion of a suction motor air duct, a dust cup, and a filter frame, consistent with embodiments of the present disclosure.

One example of a filter frame 700 disposed within the dust cup 304 is shown in FIG. 7 and another example of a filter frame 800 disposed within the dust cup 304 is shown in FIG. 8.

With reference to FIG. 7, the filter frame 700 includes one or more frame sidewalls 702 that define a filter cavity 701. The filter cavity 701 includes a dirty side open end 703 and a clean side open end 705 opposite the dirty side open end 703. A frame support 704 extends at least partially along at least one of the one or more frame sidewalls 702 and into the filter cavity 701. As shown, the frame support 704 is disposed at a location closer to the dirty side open end 703 than the clean side open end 705. The second filter medium 406 is disposed within the filter cavity 701 and contacts (e.g., is coupled to) the frame support 704. As shown, the frame sidewall 702 extends beyond the second filter medium 406 and into the plenum 408 and below a dirty air side 706 of the second filter medium 406 and the frame support 704 extends along the dirty air side 706 of the second filter medium 406.

With reference to FIG. 8, the filter frame 800 includes one or more frame sidewalls 802 that define a filter cavity 801. The filter cavity 801 includes a dirty side open end 803 and a clean side open end 805 that is opposite the dirty side open end 803. A frame support 804 extends at least partially along at least one of the one or more frame sidewalls 802 and into the filter cavity 801. As shown, the frame support 804 is disposed at a location that is closer to the clean side open end 805 than to the dirty side open end 803. The second filter medium 406 is disposed within the filter cavity 801 and contacts (e.g., is coupled to) the frame support 804. As shown, the frame support 804 extends from a distal end of the frame sidewall 802 and along a clean air side 806 of the second filter medium 406.

Figure 9:
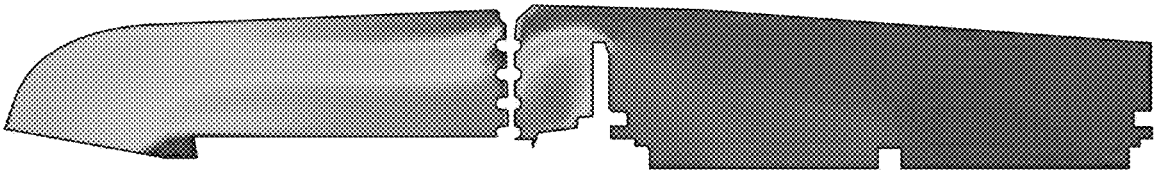
FIG. 9 is a computational fluid dynamics (CFD) analysis of a dust cup having the filter frame of FIG. 7, consistent with embodiments of the present disclosure.
Figure 10:
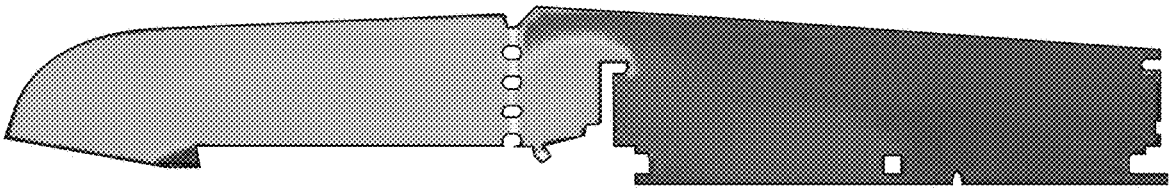
FIG. 10 is a CFD analysis of a dust cup having the filter frame of FIG. 8, consistent with embodiments of the present disclosure.
Figure 11:
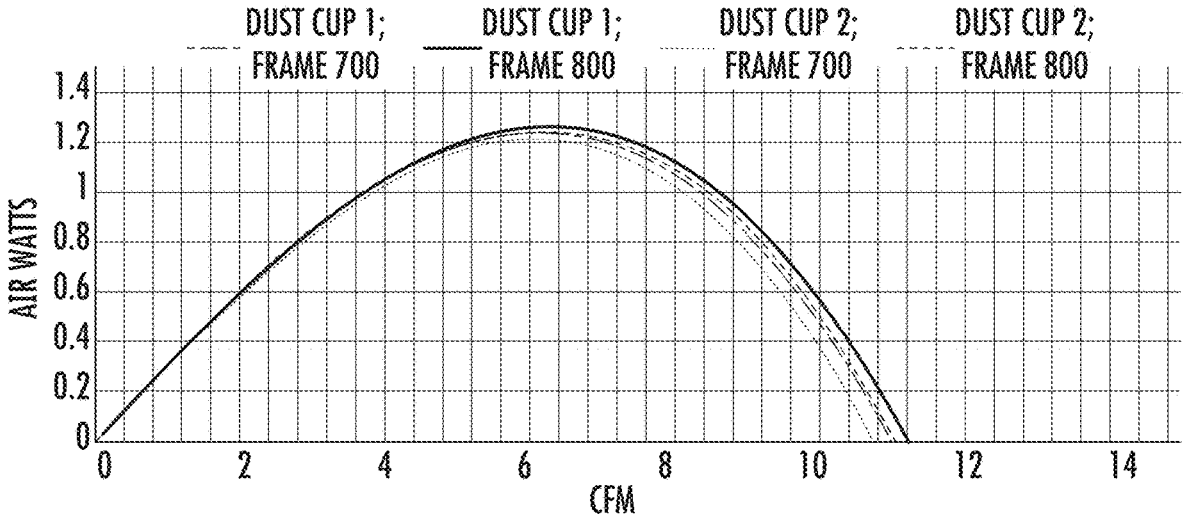
FIG. 11 is a performance plot of a first dust cup design having the filter frame of FIG. 7, the first dust cup design having the filter frame of FIG. 8, a second dust cup design having the filter frame of FIG. 7, and the second dust cup design having the filter frame of FIG. 8, consistent with embodiments of the present disclosure.

The filter frame 800 of FIG. 8 increases the plenum height 608 when compared to the filter frame 700 of FIG. 7. For example, the plenum height 608 in FIG. 8 may be approximately (e.g., within 1%, 5%, 10%, 15%, or 20% of) 1.7 mm greater than that in FIG. 7. Increasing the plenum height 608 may result in a smoother directional transition (e.g., from a vertical direction to a horizontal direction) in airflow entering the plenum 408, which may improve performance. FIG. 9 shows a computational fluid dynamics (CFD) analysis of a dust cup having the filter frame 700 and FIG. 10 shows a CFD analysis of a dust cup having the filter frame 800 of FIG. 8. FIG. 11 shows a performance plot of a first dust cup design having the filter frame 700, the first dust cup design having the filter frame 800, a second dust cup design having the filter frame 700, and the second dust cup design having the filter frame 800. As shown, the filter frame 800 can have a 3% to 4% increase in in air watts compared to filter frame 700.

An example of a robotic cleaner, consistent with the present disclosure, may include a suction motor, a dust cup, and a suction motor air duct fluidly coupled to the suction motor and the dust cup, the suction motor air duct including a debris barrier having a restricting region and a guard region.

In some instances, the restricting region may include one or more blocking plates. In some instances the one or more blocking plates may extend from a bottom portion of the suction motor air duct at a plate angle. In some instances, the plate angle may be an acute angle. In some instances, the one or more blocking plates may be integrally formed from the bottom portion of the suction motor air duct. In some instances, the guard region may include a plurality of spaced apart protrusions separated by a respective protrusion passthrough region. In some instances, each protrusion passthrough region may define an open area and a combined open area of the guard region may be in a range of 500 square millimeters ($mm^2$) to 700 $mm^2$, the combined open area being a summation of each open area in the guard region. In some instances, the dust cup further may further include a filter medium disposed within a filter frame. In some instances, the filter frame may include one or more frame sidewalls and a frame support extending from the frame sidewall. In some instances, the frame support may extend from a distal end of at least one of the one or more frame sidewalls and along a clean air side of the filter medium. In some instances, the restricting region may include a plurality spaced apart blocking plates separated by a respective plate passthrough region. In some instances, the plate passthrough region may include an obstruction plate.

An example of a suction motor air duct, consistent with the present disclosure, may include a duct top portion, a duct bottom portion, and a debris barrier having a restricting region and a guard region, wherein the restricting region includes one or more blocking plates and the guard region includes a plurality of spaced apart protrusions separated by a respective protrusion passthrough region.

In some instances, the one or more blocking plates may extend from the duct bottom portion. In some instances, the protrusions may extend from the duct top portion in a direction of the one or more blocking plates. In some instances, the protrusions may be spaced apart from a respective one of the one or more blocking plates by a plate-protrusion separation distance. In some instances, the plate-protrusion separation distance may be less than, or equal to, a protrusion separation distance, the protrusion separation distance extending between immediately adjacent protrusions. In some instances, the one or more blocking plates may be integrally formed from the duct bottom portion. In some instances, the protrusions may be integrally formed from the duct top portion.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A robotic cleaner comprising:

a dust cup having a dirty air inlet;

a suction motor configured to cause air having entrained debris to flow into the dirty air inlet of the dust cup along a flow path according to an air flow direction such that at least a portion of the entrained debris is deposited in the dust cup, the dust cup being upstream of the suction motor along the flow path relative to the airflow direction; and a suction motor air duct fluidly coupled to the suction motor and the dust cup at a location downstream of the dust cup and upstream of the suction motor relative to the airflow direction, such that the flow path extends from the dust cup into the suction motor air duct, the suction motor air duct including a duct inlet through which the flow path enters the suction motor air duct and a debris barrier having a restricting region and a guard region, the restricting region including:

a first blocking plate extending from a bottom portion of the suction motor air duct towards a top portion of the suction motor air duct at a non-perpendicular plate angle and including an airflow side that defines at least a portion of an inner surface of the suction motor air duct such that air flowing along the air flow path is incident on the airflow side, wherein the first blocking plate restricts an inlet open area of the duct inlet; and the guard region including:

a first protrusion extending from the top portion of the suction motor air duct towards the first blocking plate such that air flowing along the air flow path is incident on the first protrusion, the first protrusion being spaced apart from the first blocking plate and having a protrusion length that increases from a first length to a second length in the air flow direction along the flow path such that an end profile of the first protrusion is shaped such that at least a portion of the first protrusion extends over and along the airflow side of the first blocking plate.

2. The robotic cleaner of claim 1, wherein the plate angle is an acute angle.

3. The robotic cleaner of claim 1, wherein the first blocking plate is integrally formed from the bottom portion of the suction motor air duct.

4. The robotic cleaner of claim 1, wherein the guard region includes a second protrusion spaced apart from the first protrusion to define a protrusion passthrough region.

5. The robotic cleaner of claim 1, wherein the dust cup further comprises a filter medium disposed within a filter frame.

6. The robotic cleaner of claim 5, wherein the filter frame includes one or more frame sidewalls and a frame support extending from the frame sidewall.

7. The robotic cleaner of claim 6, wherein the frame support extends from a distal end of at least one of the one or more frame sidewalls and along a clean air side of the filter medium.

8. The robotic cleaner of claim 1, wherein the restricting region includes a second blocking plate separated from the first blocking plate by a plate passthrough region.

9. The robotic cleaner of claim 8, wherein the plate passthrough region includes an obstruction plate.

10. A robotic cleaner comprising:

a dust cup having a dirty air inlet, a debris cavity, a filter medium, a plenum, and a clean air outlet, wherein a plenum bottom portion of the plenum is defined, at least in part, by the filter medium;

a suction motor configured to cause air having entrained debris to flow into the dirty air inlet of the dust cup along a flow path according to an air flow direction such that at least a portion of the entrained debris is deposited in the debris cavity, the dust cup being upstream of the suction motor along the flow path relative to the airflow direction; and a suction motor air duct fluidly coupled to the clean air outlet at a location downstream of the dust cup and upstream of the suction motor relative to the airflow direction, the suction motor air duct including a duct inlet and a debris barrier having a restricting region and a guard region, the restricting region including:

a blocking plate having an airflow side, wherein air drawn into the suction motor air duct by the suction motor is incident on the airflow side of the blocking plate, the blocking plate extending from a duct bottom portion of the suction motor air duct towards a duct top portion of the suction motor air duct and a top surface of the blocking plate being coplanar with a plane defined by the filter medium, wherein the blocking plate restricts an inlet open area of the duct inlet; and the guard region including:

a protrusion extending from the duct top portion of the suction motor air duct towards the first blocking plate, the protrusion having a first protrusion length and a second protrusion length downstream of the first protrusion length relative to the air flow direction, the second protrusion length being greater than the first protrusion length such that at least a portion of an end profile of the protrusion extends over and along the airflow side of the blocking plate.

11. The robotic cleaner of claim 10, wherein the protrusion is integrally formed from the duct top portion.

12. The robotic cleaner of claim 10, wherein the blocking plate is integrally formed from the duct bottom portion.

13. The robotic cleaner suction motor air duct of claim 10, wherein the guard region includes a second protrusion and a plate-protrusion separation distance is less than, or equal to, a protrusion separation distance, the protrusion separation distance extending between the protrusion and the second protrusion.

* * * * *